US010266296B2

(12) United States Patent
Roozen et al.

(10) Patent No.: US 10,266,296 B2
(45) Date of Patent: Apr. 23, 2019

(54) METHOD FOR STORAGE AND/OR TRANSPORT OF LACTIDE PARTICLES

(71) Applicant: PURAC Biochem BV, Gorinchem (NL)

(72) Inventors: Lambertus Hendricus Roozen, Gorinchem (NL); Johannes Adrianus Kamp, Gorinchem (NL); Kees Van der Voort Maarschalk, Gorinchem (NL); Maarten Hendrik Wieringa, Gorinchem (NL)

(73) Assignee: Purac Biochem BV, Gorinchem (NL)

( * ) Notice: Subject to any disclaimer, the term of this patent is extended or adjusted under 35 U.S.C. 154(b) by 459 days.

(21) Appl. No.: 14/888,265

(22) PCT Filed: Apr. 28, 2014

(86) PCT No.: PCT/EP2014/058592

§ 371 (c)(1),
(2) Date: Oct. 30, 2015

(87) PCT Pub. No.: WO2014/177512

PCT Pub. Date: Nov. 6, 2014

(65) Prior Publication Data

US 2016/0075461 A1 Mar. 17, 2016

(30) Foreign Application Priority Data

May 2, 2013 (EP) ..... 13166320
Sep. 23, 2013 (EP) ..... 13185567

(51) Int. Cl.
*B65B 7/02* (2006.01)
*B65B 29/00* (2006.01)
(Continued)

(52) U.S. Cl.
CPC ..... *B65B 69/0075* (2013.01); *B65B 7/02* (2013.01); *B65B 29/00* (2013.01); *B65B 31/00* (2013.01); *B65D 88/1618* (2013.01)

(58) Field of Classification Search
CPC ..... B65B 31/00; B65B 31/04; B65B 69/0075; B65B 69/0083; B65D 88/1618; B65D 2588/165
(Continued)

(56) References Cited

U.S. PATENT DOCUMENTS 2,612,924 A * 10/1952 Cunningham ..... B65D 88/1637 280/DIG. 7
2,858,051 A 10/1958 Cunningham et al.
(Continued)

FOREIGN PATENT DOCUMENTS

EP 0180379 A2 * 5/1986 ..... B65D 88/1618
WO 2005080229 A2 9/2005

OTHER PUBLICATIONS

International Search Report and Written Opinion dated Aug. 5, 2014 for corresponding International Application No. PCT/EP2014/058592, filed Apr. 28, 2014.

*Primary Examiner* — Stephen F. Gerrity
(74) *Attorney, Agent, or Firm* — Peter J. Ims; Westman, Champlin & Koehler, P.A.

(57) ABSTRACT

A method for storage and/or transport of solid lactide particles in a container, includes the steps of a) inserting the lactide particles into the container, b) storing and/or transporting the lactide particles for a period of time in the container, and c) removing the lactide particles from the container. The lactide particles are contained in a big-bag having at least one flexible layer of a plastic material. Storage and/or transport of lactide particles in such big-bag
(Continued)

has the advantage that big-bags allow mechanical handling in case of chunks formed by the lactide particles.

7 Claims, 1 Drawing Sheet

(51) Int. Cl.
*B65B 31/00* (2006.01)
*B65B 69/00* (2006.01)
*B65D 88/16* (2006.01)

(58) Field of Classification Search
USPC ..... 53/434, 436, 437, 469, 492, 512, 121, 53/523, 525, 526, 284.7; 414/415
See application file for complete search history.

(56) References Cited

U.S. PATENT DOCUMENTS 4,946,291 A * 8/1990 Schnaars ..... B65D 88/1618 383/109
4,966,311 A * 10/1990 Taylor ..... B65B 69/0091 222/105
5,699,730 A * 12/1997 Ogier et al. ..... B65B 69/0091 100/233
5,759,649 A * 6/1998 Dinter et al. ..... B32B 7/02 428/35.3
5,788,449 A * 8/1998 Riemersma ..... B65B 69/0091 222/103
5,806,283 A * 9/1998 Shafer ..... B65B 31/04 53/434
5,809,744 A * 9/1998 Villines et al. ..... B65B 1/16 141/314
5,947,333 A * 9/1999 Hoffmann et al. ..... B65B 69/0091 222/105
6,186,360 B1 * 2/2001 Becker et al. ..... B65B 69/0091 222/1
6,653,377 B1 * 11/2003 Lloyd et al. ..... B65B 1/28 524/221
7,223,058 B2 * 5/2007 Nyhof ..... B65B 69/0091 414/415
8,181,568 B1 * 5/2012 Hofman et al. .... B01F 11/0065 100/233
8,182,152 B2 * 5/2012 Plunkett ..... B32B 27/08 383/105
8,203,008 B2 6/2012 De Vos
2003/0116460 A1 * 6/2003 Berke ..... B65D 88/1612 206/386
2003/0206790 A1 * 11/2003 Nyhof ..... B65B 69/0091 414/415
2005/0199650 A1 9/2005 Nyhof et al.
2005/0257502 A1 * 11/2005 Wild et al. ..... B65B 55/06 53/434
2007/0169843 A1 * 7/2007 Henderleiter, Sr. ... B05B 7/1404 141/315
2007/0201774 A1 8/2007 Plunkett et al.
2008/0146822 A1 * 6/2008 De Vos ..... C07D 319/12 549/274
2008/0307755 A1 * 12/2008 Stelliferi et al. ..... B65B 31/00 53/469

* cited by examiner

METHOD FOR STORAGE AND/OR TRANSPORT OF LACTIDE PARTICLES

CROSS REFERENCE TO RELATED APPLICATIONS

This Application is a Section 371 National Stage Application of International Application No. PCT/EP2014/058592, filed Apr. 28, 2014 and published as WO 2014/167069 A1 on Oct. 16, 2014, in English which claims priority to European Patent Application No. 13166320.5 filed on May 2, 2013 and European Patent Patent Application 13185567.8 filed on Sep. 23, 2013.

BACKGROUND

The discussion below is merely provided for general background information and is not intended to be used as an aid in determining the scope of the claimed subject matter.

The present disclosure relates to a method for storage and/or transport of solid lactide particles in a container, said method comprising the following steps: a) inserting the lactide particles into the container, b) storing and/or transporting the lactide particles for a period of time in the container, and c) removing the lactide particles from the container. The disclosure also relates to the use of an optimized container for storage and/or transport of lactide particles.

U.S. Pat. No. 8,203,008 describes lactide particles having a certain surface/volume ratio, which are stable enough to be stored and transported at room temperature, and which have a quality enough for use as a starting material for the production of polylactide (PLA) or other products that contain lactide. In laboratory scale experiments, small amounts of lactide particles have been stored in air-tight and vapor-tight bags, comprising a polyethylene inner bag contained in an aluminum bag.

In the current storage and transport of lactide (sometimes named 'di-lactide') in particulate form in mass production amounts, so-called octabins are widely used as a container of lactide particles. Octabins are large, dimensionally standardized containers made of thick cardboard, optionally being provided with an inner polyethylene bag (inner-liner). The major part of the mechanical strength of octabins is provided by the cardboard parts. Octabins usually have a width from 80 to 120 cm and a depth of 120 cm and vary in height from 50 cm up to 200 cm. Their capacity is normally around 1,000 kg but the larger units can store even 1,700 kg. Emptying is made easy by either tilting the octabin, opening a hole in the side of it or by suction.

Applicant has observed that under certain circumstances, the unloading of the lactide particles from an octabin causes problems. More specifically, continuous flow-out of the lactide particles from the octabin does not always occur under such circumstances. Complete and controlled emptying the container need additional measures, which may even lead to destruction of the octabin, so that handling time and/or costs of the unloading step are increased.

The disclosure has as an objective to solve or at least mitigate the above-mentioned technical problem. More particularly, the invention aims at providing a method for storage and/or transport lactide particles, in which hampered flow of the particles out from the container can be easily obviated. The invented method should moreover be cost-effective and easily implementable in supply chains.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background.

These and possible other objects of the disclosure are achieved by means of a method for storage and/or transport of solid lactide particles in a container, said method comprising the following steps:

- inserting the lactide particles into the container,
- storing and/or transporting the lactide particles for a period of time in the container,
- removing the lactide particles from the container, characterized in that the lactide particles are contained in a big-bag, comprising at least one flexible layer of a plastic material.

The disclosure is based on the recognition by the inventors that the inflexible structure of octabins is a prime reason that the reduction of the flowability of lactide in particulate form cannot easily be obviated. The disclosure is further based on an improved insight in behavior of lactide particles under various conditions. The inventors have found that under certain conditions lactide particles may become slightly sticky, which causes the formation of chunks. Such chunks change the free flowing behavior by reducing the flowability and prevent the flow-out of the lactide particles during unloading the lactide material from octabins. However, due to their greater flexibility, better flow-out is achieved when using big-bags comprising at least one flexible layer of plastic material, instead of octabins as containers for lactide particles. For the proper execution of the present method it is important that the number of cardboard parts is as low as possible, and that such parts are preferably completely absent in the container. In the containers used in the method according to the invention, the majority of the mechanical strength during storage and/or transport is provided by the flexible layer of plastic material.

A big-bag, also called FIBC (flexible intermediated bulk container), bulk-bag, super sack, or jumbo-bag, is a container having large dimensions for storage and/or transport of dry flowable products. They normally measure around 110 centimeter in diameter or around 100 cm in square and vary in height between 100 and 300 centimeters, giving them a capacity of at least a couple of 100 kgs. The bags are normally provided with one, two or four lifting hooks. In its minimal construction, a big-bag comprises a single, preferably woven, layer of flexible plastic material, like polyethylene or polypropylene, said layer being formed as a bag-like container. The flexibility of such big-bags allows them to be treated by applying mechanical forces, like kicking or beating the container, to improve the flowing behavior of lactide particles and to reduce the size of the chunks. Such treatments are undesired when using octabins, which may be damaged by such actions due to their inflexible outer structure of cardboard. The major part of the mechanical strength of a big-bag is provided by the flexible layer(s) of (woven) plastic material. Based on the physical properties of the lactide particles to be stored and/or transported, a skilled person can select a suitable type and thickness of said layer(s).

The method can be applied on various types of lactide particles, like pellets, pastilles and granules. However, the inventive measure is especially effective in case that the lactide is available in flake form or powder form. It is noted that lactide can exist in three different geometric structures, which have a diastereomeric relationship. These different structures can be distinguished as R,R-lactide (or D-lactide), S,S-lactide (or L-lactide) and R,S-lactide (or meso-lactide). The method is especially useful for storing and/or transporting particles of D-lactide or L-lactide as well as mixtures of particles made of these two lactides. It is further noted that L-lactide may comprise a small amount of another isomer, such as D-lactide or R.S-lactide. This amount is usually smaller than 20 wht. %, preferably less than 10 wht. %, more preferably less than 5 wht. % and most preferably less than 2 wht. %.

An interesting embodiment of the method is characterized in that the big-bag is submitted to a mechanical crushing operation before removing the lactide particles from the big-bag. Such operation may be applied in case that a substantive part of the lactide particles present in the big-bag is agglomerated into chunks. The process of agglomerate formation is also referred to as 'caking'. In such situation, the big-bag may be positioned in a crushing tool, which causes a mechanical force on the big-bag, like crushing, pressing, hammering, vibrating, etc. This mechanical force causes that the bonds between the particles in the agglomerates are broken, so that the particles are again able to flow freely.

Another interesting embodiment of the method has the feature that, before inserting the lactide particles, the big-bag is filled with a chemically inert gas, which gas is preferably selected from carbon dioxide, nitrogen and argon, or a mixture thereof. Said filling of the big-bag can be affected in various ways. Thus, the empty and folded big-bags may be first inflated with a gas like (dry) air, and subsequently be flushed with a chemically inert gas. The empty and folded big-bags may however also be inflated directly with an inert gas. Although carbon dioxide and argon also work fine, the use of nitrogen, and especially dried nitrogen, is preferred in this embodiment of the invention.

A further interesting embodiment of the method is characterized in that the big-bag is closed after the lactide has been inserted into it. This measure causes that the undesired supply of moisture and/or oxygen from the direct outside of the big-bag into the lactide in particulate form is limited. This is especially effective in case that the lactide has to be stored or transported for a long period of time. Closure of the big-bag is preferably done by sealing the open ends at the so-called inlet-spout of the flexible layer of plastic material.

Also interesting is the embodiment of the method in which the big-bag is evacuated after the lactide has been inserted into it and before the big-bag is closed. By evacuation, any gas present inside the lactide-filled big-bag container is substantially removed. As a consequence, small traces of unwanted oxygen and/or moisture which may be mixed with the chemically inert gas may be removed as well by such evacuation from the inside of the big-bag. This measure therefore reduces the risk on formation of side-products by reacting with the lactide particles.

Yet another embodiment of the method is characterized in that the at least one layer of the big-bag is provided with an inner-liner having a moisture barrier layer. The presence of such moisture barrier layer causes that penetration of undesired moisture from the environment is minimized. Such layer may be provided directly on the flexible layer of plastic material. As an alternative, said moisture barrier layer may also be present as a self-supporting layered bag positioned inside of the flexible layer of the big-bag container. Having the moisture barrier layer present as a laminate layer (for example sandwiched between two polyolefin layers) is however preferred.

Another different embodiment of the method has the feature that the inner-liner is provided with an oxygen barrier layer. The presence of such oxygen barrier layer causes that penetration of undesired oxygen from the environment is minimized. Such layer may be provided together with the moisture barrier layer on an inner-liner. As an alternative, said oxygen barrier layer may also be present as a self-supporting layered bag positioned at the inside of the flexible layer of the big-bag container. Having the oxygen barrier layer present as a laminate layer (for example sandwiched between two polyolefin layers) is however preferred.

The disclosure also relates to the use of a big-bag comprising at least one flexible layer of a plastic material for storing and/or transporting of lactide in a particulate form. Said big-bag is preferably characterized in that the at least one layer of the big-bag is provided with a moisture barrier layer and/or in that the at least one layer is (also) provided with an oxygen barrier layer. The use of these types of big-bags in the storage and/or transport of lactide particles has the advantage that possible flow-out of the lactide particles due to chunk formation can be easily obviated by simple mechanical means.

BRIEF DESCRIPTION OF THE DRAWING

These and other aspects of the invention will be apparent from and elucidated with reference to the embodiments described hereinafter.

In the drawing.

It is stressed that the Figures are schematic and not to scale.

DETAILED DESCRIPTION OF EMBODIMENTS

In a comparative experiment, the storage and transport of lactide particles in a container not according to the invention (embodied as an octabin) and in a container according to the present invention (embodied as a big-bag) were investigated. For that purpose, an octabin of the type bag in bag (volume 600 kg) having an inner-liner of polyethylene with an oxygen barrier layer and a moisture barrier layer was filled with lactide flakes (PURALACT L). A big-bag (volume 600 kg) having an inner-liner of polyethylene with an oxygen barrier layer and a moisture barrier layer was filled for approximately 70 vol. % with lactide flakes (PURALACT L). Before filling, both types of containers were flushed with a stream of nitrogen gas. After the filling operation with lactide, both containers were sealed and subsequently stored for 30 days at a temperature of 40° C. Before and after the period of storage, the moisture content and the acidity of the lactide were determined.

Figure 1:
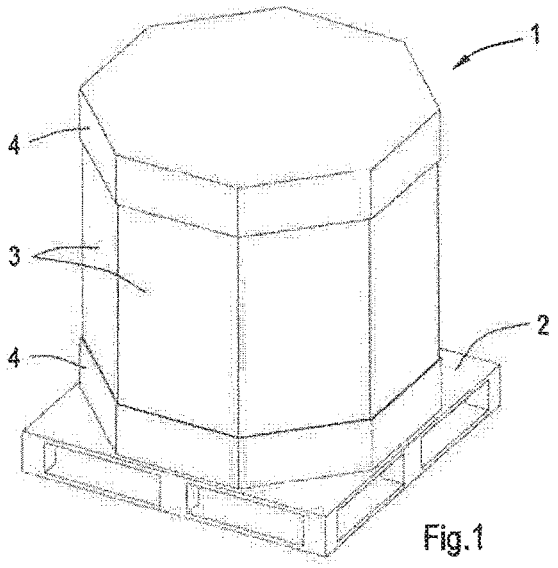
Fig.1 PRIOR ART
FIG. 1 shows a container embodied as an octabin for storage and/or transport of lactide particles (not according to the disclosure)

FIG. 1 shows a perspective view of an octabin 1, which is positioned on a pallet 2. The vertical sides 3 of the octabin have an eight-sided horizontal circumference and are made of cardboard. The octabin is covered on top and bottom with removable covers 4 of cupboard. The octabin comprises an inner-liner of polyethylene (not shown), which is provided with a layer of aluminum as a moisture barrier layer and an oxygen barrier layer.

Figure 2:
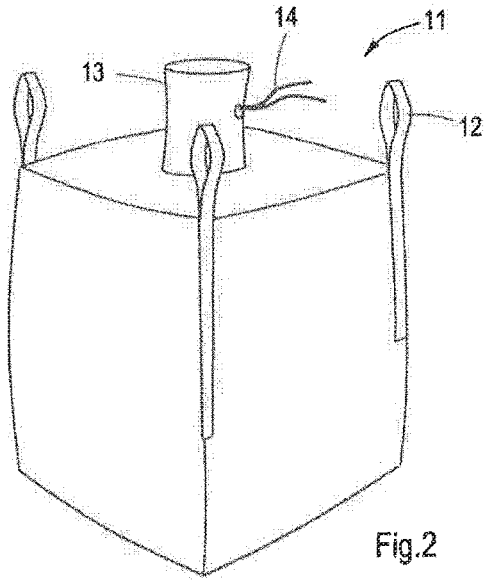
FIG. 2 shows a container embodied as a big-bag for storage and/or transport of lactide particles (according to the present disclosure).

FIG. 2 shows a perspective view of a big-bag 11, which is made of a flexible, woven layer of polyethylene and/or polypropylene. The big-bag container is provided with four hooks 12 for lifting the big-bag. It is also provided with an inlet spout 13 at the top of the big-bag and an outlet spout (or discharge spout) at the bottom of the big-bag (not shown). Inside the flexible layer of the big-bag, a laminated inner-liner of an aluminum layer sandwiched between two polyethylene layers is attached (not shown). The inner-liner is also provided with an inlet spout and an outlet spout. Said spouts may be sealed to prevent inlet of atmospheric gas. The spouts attached to the flexible layer may be closed by means of short ropes 14.

After the 30 days of storage at 40° C. of the lactide particles, some chunk formation ('caking') appeared to have occurred in both types of containers, which caused flow-out problems of the lactide flakes during emptying the containers. However, the lactide outflow from the big-bag containers appeared to be significantly better and quicker than from the octabin container. Moreover, the dimensions of the remaining chunks in the big-bag could easily be reduced by applying mechanical forces (crushing or beating the flexible plastic layer of the container). Reducing lactide chunks in the octabin container appeared to be more difficult, as comparable mechanical actions were not possible in view of expected damage to the cardboard surfaces surrounding said octabin container.

The same containers with the same lactide material (again in flake form) were stored for 90 days at the same temperature of 40° C. After this period, severe caking appeared to have been occurred in both containers. Removing the lactide from the octabin container was only possible after destruction of the octabin. The lactide could not be removed in a simple manner from the big-bag, even not after applying the simple mechanical action of kicking, beating or crushing the outside of this container. However, the dimensions of the lactide chunks could be reduced by means of a mechanical crushing operation applied on the container before removing the lactide. For this purpose, the big-bag was positioned on a pallet in a hydraulic crushing apparatus. Due to the flexible wall of the big-bag, this apparatus was able to press the container with a pressure of several bars. During said crushing operation, the chunks substantially disintegrated into lactide powder, without damage to the big-bag. Such crushing operation could not be applied to octabins, due to immediate damage of the outer walls of cardboard Some simple experiments showed the effect of the oxygen and the moisture barrier layers. In the absence of these layers, the moisture and oxygen content in the containers (both the octabin and the big-bag type) appeared to be higher than when these layers were present.

In summary, the above-described experiments clearly show that storage and/or transport of lactide particles in big-bag containers has a clear advantage over their storage in octabin containers. This is because big-bags are flexible whereas octabins are not. This difference allows mechanical handling of big-bags in case of chunks formed by the lactide particles, whereas such handling is not possible for octabins.

While aspects of the invention has been illustrated and described in detail in the drawing and foregoing description, such illustration and description are to be considered illustrative or exemplary and not restrictive. The invention is not limited to the disclosed embodiments. Other variations to the disclosed embodiments can be understood and effected by those skilled in the art in practicing the claimed invention, from a study of the drawings, the disclosure, and the appended claims.

In the claims, the word 'comprising' does not exclude other elements or steps, and the indefinite article 'a' or 'an' does not exclude a plurality. The mere fact that certain measures are recited in mutually different claims does not indicate that a combination of these measures cannot be used to advantage. Any reference signs in the claims should not be construed as limiting the scope of these claims.

The invention claimed is:

1. A method for storage and/or transport of solid lactide particles in a big-bag comprising at least one flexible layer of a plastic material, said method comprising the following steps:

providing an unfilled big-bag;

filling the unfilled big-bag with a chemically inert gas;

inserting the lactide particles into the big-bag filled with the chemically inert gas;

evacuating the big-bag containing the lactide particles and chemically inert gas to substantially remove the gas from the big-bag, closing the evacuated big-bag containing the lactide particles;

storing and/or transporting the lactide particles for a period of time in the evacuated big-bag; and removing the lactide particles from the evacuated big bag.

2. The method according to claim 1, further comprising the step of submitting the evacuated big-bag containing the lactide particles to a mechanical crushing operation before removing the lactide particles from the big-bag.

3. The method according to claim 2, and wherein the mechanical crushing operation utilizes a hydraulic crushing apparatus.

4. The method according to claim 3, and further comprising: placing the evacuated big-bag containing the lactide particles on a pallet prior to utilizing the hydraulic crushing apparatus.

5. The method according to claim 1, wherein the chemically inert gas is selected from carbon dioxide, nitrogen and argon, or a mixture thereof.

6. The method according to claim 1, wherein the at least one flexible layer of the big-bag is provided with an inner-liner having a moisture barrier layer.

7. The method according to claim 6, wherein the inner-liner includes an oxygen barrier layer.

* * * * *